United States Patent [19]

Regan et al.

[11] 4,070,603

[45] Jan. 24, 1978

[54] SOLID STATE MICROWAVE POWER SOURCE FOR USE IN AN ELECTRODELESS LIGHT SOURCE

[75] Inventors: Robert J. Regan, Needham; Paul O. Haugsjaa, Acton; William H. McNeill, Carlisle, all of Mass.

[73] Assignee: GTE Laboratories Incorporated, Waltham, Mass.

[21] Appl. No.: 705,324

[22] Filed: July 14, 1976

[51] Int. Cl.[2] ..... H05B 41/16; H05B 41/24

[52] U.S. Cl. ..... 315/248; 315/39; 315/267; 315/344; 333/84 M

[58] Field of Search ..... 315/248, 39, 151, 158, 315/159, 104, 267, 283, DIG. 7, 344, 149; 250/504, 372, 373; 333/84 M

[56] References Cited

U.S. PATENT DOCUMENTS

| | | | |
|---|---|---|---|
| 3,230,422 | 1/1966 | Gourber et al. | 315/248 |
| 3,500,118 | 3/1970 | Anderson | 315/248 X |
| 3,873,884 | 3/1975 | Gabriel | 315/344 |
| 3,943,401 | 3/1976 | Haugsjaa et al. | 315/248 |
| 3,965,445 | 6/1976 | Ou | 333/84 M |
| 3,999,142 | 12/1976 | Presser et al. | 333/84 M |

*Primary Examiner*—Saxfield Chatmon, Jr.

*Attorney, Agent, or Firm*—Leslie J. Hart; Irving M. Kriegsman; Fred Fisher

[57] ABSTRACT

A solid state microwave power source for providing microwave power to excite an electrodeless lamp is designed so as to provide an acceptable impedance matching characteristic during lamp warm-up when the lamp impedance is high and changing with temperature to provide sufficient power to the lamp during the running state when the lamp impedance is matched to the source. The microwave power source includes a dc power source providing power at variable levels, a microwave oscillator receiving the dc power to produce a microwave signal, and a microwave power amplifier. The oscillator has a transistor in a common base configuration, a microstrip capacitive feedback element to sustain oscillations, and an output impedance matching arrangement formed from microstrip. The microwave signal is amplified in the solid state power amplifier having a power transistor in a common base configuration. An impedance matching section between the amplifier and the input of a termination fixture for the lamp includes a length of transmission line which transforms the input impedance of the fixture to a level at the collector of the power transistor in the amplifier so as to maximize the power delivered to the lamp at reduced power levels while maintaining the collector voltage within a safe limit.

13 Claims, 3 Drawing Figures

SOLID STATE MICROWAVE POWER SOURCE FOR USE IN AN ELECTRODELESS LIGHT SOURCE

CROSS-REFERENCE TO RELATED APPLICATIONS

A concurrently filed application, Ser. No. 705,323, entitled "Automatic Starting System For Solid State Powered Electrodeless Lamps", is assigned to the same assignee herein, and is filed in the name of William H. McNeill, Paul O. Haugsjaa, Joseph Lech and Robert J. Regan. Also, a concurrently filed application, Ser. No. 705,328, entitled "Continuous Automatic Starting Assist Circuit For A Microwave Powered Electrodeless Lamp" is assigned to the same assignee herein, and is filed in the name of Robert J. Regan, Paul O. Haugsjaa and William H. McNeill.

BACKGROUND OF THE INVENTION

The present invention relates to a microwave excited electrodeless light source and, more specifically, to a solid state microwave power source for use in the light source.

In a microwave powered electrodeless light source of the type described in the U.S. Pat. No. 3,943,403, it is necessary to provide sufficient microwave power to the electrodeless lamp for both starting the lamp and just after glow initiation so that the lamp goes through the transition period from low pressure glow to higher pressure arc quickly and safely with respect to the solid state power device and reaches the full running condition. The load impedance presented to the microwave power source just after glow initiation is quite different than that presented when the lamp is in the running condition. In the glow condition, the lamp impedance has a very high real part, of the order of 1500 ohms. In the running condition, the lamp impedance is lower, of the order of 150 ohms, and has been effectively matched to the output impedance of the power source via the lamp fixture and its impedance matching schemes.

At microwave frequencies the load during the glow condition results in a very high voltage standing wave ratio (VSWR) on the transmission line between the source of microwave power and the load. High voltage standing wave ratios may cause excessive voltages at the collector of the amplifier transistor in a microwave power source, and this condition could cause breakdown. In addition, since a high VSWR type load results in reflection of forward directed power back into the microwave power source, the source must dissipate this power as heat. This may result in a thermal overload. The full running condition has a finite impedance determined by lamp parameters, such as lamp geometry, chemical fill material, operating frequency, wall temperature and pressure. Since the performance of any unregulated power source is load dependent, and in particular a solid state microwave power source is extremely load dependent, it is necessary to promote the compatability of the solid state microwave power source with the input impedance of the fixture housing the lamp by careful design of the power source.

A component called a circulator inserted in the line between the microwave power source and the fixture for the lamp has been used previously to protect this microwave power source. This device contains a magnetoactive ferrite material which has non-reciprocal properties such that it directs the flow of power. The circulator allows the maximum forward power to be delivered to the lamp, and in the case of an impedance mismatch, such as when the lamp is off or just after the glow is initiated, the reflected power is diverted by the circulator to a resistive termination and dissipated as heat. While this device does protect the power source, the device along with its associated terminating resistor is bulky and expensive and represents a power loss in the line. Its use is not desirable in a practical electrodeless lamp system.

SUMMARY OF THE INVENTION

It is an object of the invention to provide an improved solid state microwave power source for an electrodeless light source which may be fabricated to have a size and shape similar to a conventional incandescent lamp.

It is another object of the invention to provide a power source having adequate power delivery to the lamp during the glow condition period while not exposing the source to an excessive load impedance mismatch even though during the glow condition the lamp impedance is very high initially and dynamically changes.

It is still another object of the invention to provide a power source which after starting and during the glow condition provides optimum lamp performance by allowing the maximumm available power to be delivered to the lamp.

In one aspect of the invention, there is provided an improved microwave power source for use with an electrodeless light source. The light source is of the type including a microwave power source and an electrodeless lamp having a light-transmitting envelope and a volatile fill material which emits light upon breakdown and excitation. A termination fixture is provided and has an inner conductor and an outer conductor disposed around the inner conductor. The conductors have a first end coupled to the source and a second end associated with the lamp so that the microwave power terminates at the lamp to initiate breakdown and excitation of the fill material. The fixture further has a device for matching the impedance of the lamp in the running condition to the output impedance of the source and a starting assist device when power is first applied at a reduced level to the lamp. Accordingly, the improved microwave power source includes a dc power source capable of providing power at variable levels, a solid state microwave oscillator, responsive to the output of the dc power source, for generating a microwave signal, and a solid state microwave power amplifier, responsive to the output of the dc power source, for increasing the power level of the microwave signal. The amplifier includes a power transistor, the collector circuit of the amplifier forming the output of the microwave power source. An impedance matching device is coupled between the amplifier and the first end of the conductors of the fixture and includes a length of transmission line which is effective to transform the dynamic input impedance of the fixture after the lamp is started and before the lamp is in a running condition to a value at the collector of the amplifier transistor that is acceptable to the device. This allows an amount of power to be delivered to the lamp even when the amplifier receives reduced dc power, sufficient to cause the lamp to warm up to the running condition. This impedance matching scheme maintains the collector voltage at an acceptable level during the time when a large impedance mismatch occurs between the amplifier output impedance and the input impedance of the fixture.

DESCRIPTION OF PREFERRED EMBODIMENT

Figure 1:
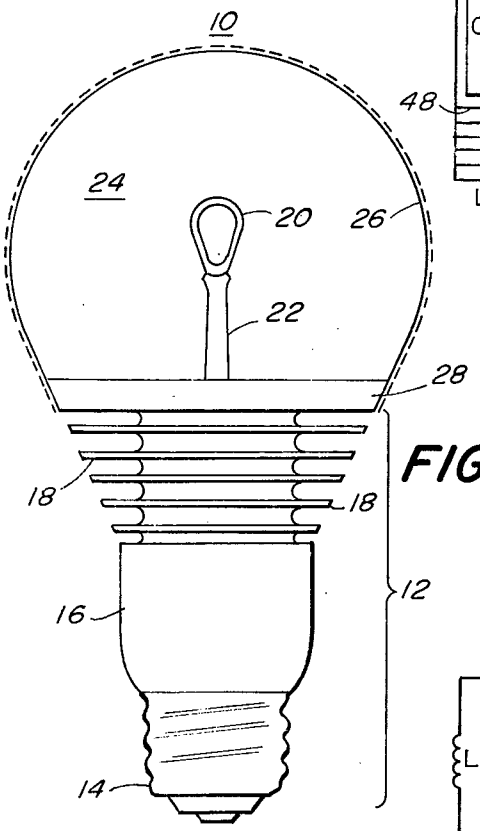
FIG. 1 is a pictorial representation of the electrodeless light source having a shape and size similar to that of an incandescent lamp.

In an exemplary embodiment of the present invention, as illustrated in FIG. 1, there is provided an electrodeless light source represented generally by the reference numeral 10. The light source 10 is shown as having a shape and size substantially similar to a conventional incandescent lamp, such as the A19 size, 100 watt bulb manufactured by Sylvania, Inc.

Within the neck portion 12 of the light source 10 is located the improved microwave power source which includes a screw base 14 adapted to be inserted into a conventional socket providing electrical power at 60 Hz, a section 16 housing a portion of the solid state ac to microwave power source and a heat sink 18 for dissipating heat due to inefficient power conversion. The power source includes an ac to dc converter, which rectifies and, if desired, filters the line power, and a microwave power source driven by the output of the dc power source. Microwave power is coupled to an electrodeless lamp 20 directly from the output of the microwave power source via an inner conductor 22 of a termination fixture 24. The lamp 20 has a light-transmitting envelope and a volatile fill material which emits light upon breakdown and excitation. The termination fixture has an outer conductor 26 such as a metallic mesh associated with a light-transmitting envelope enclosing the lamp 20 and the inner conductor 22. A region 28 at the power coupled end of the inner and outer conductors houses an impedance matching device, such as a tunable capacitor, which is more fully described in U.S. Pat. No. 3,943,403 and a starting assist device, such as a resonance creating capacitor and/or a UV light source described in the concurrently filed patent application entitled "Automatic Starting System For Solid State Powered Electrodeless Lamps", Ser. No. 705,323, filed July 14, 1976. The impedance matching device matches the lamp impedance in the running condition to the output impedance of the source. The UV source assists in initiating and sustaining the glow condition of the lamp, and the starting capacitor creates the condition of resonance in the fixture at starting and during the glow condition. In addition, the region between the conductors 22 and 26 is preferably evacuated, such as is more fully described in a patent application, Ser. No. 705,327, filed July 14, 1976, entitled "Electrodeless Light Source With Reduced Heat Losses" by Haugsjaa et al. and assigned to the same assignee as the present invention, to reduce conductive and convective heat losses.

Figure 2:
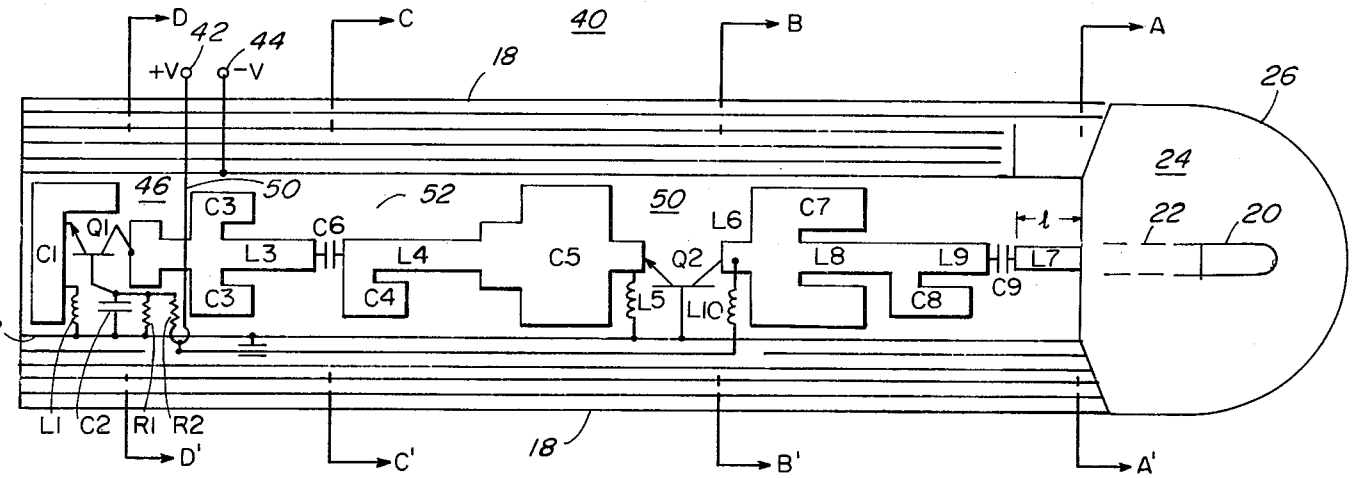
FIG. 2 is a pictorial drawing of an electrodeless light source showing the improved solid state microwave power source according to the invention.

FIG. 2 shows a pictorial drawing of the light source with an improved solid state microwave power source 40 which is physically located in the section 16 and within the heat sink 18 of FIG. 1. The dc power source, shown for simplicity as terminals 42 and 44, provides dc power at variable levels. At starting, the voltage at 42 is intentionally reduced so as to protect the microwave power source by coupling the UV light source in series between the dc source and the microwave source. In addition, the dc source may include a potentiometer or other voltage reducing devices for providing a dimming feature when the lamp 20 is in the running condition. A solid state oscillator, represented generally by the reference numeral 46, is responsive to the output of the dc power source for providing a microwave signal. The oscillator 46 includes a transistor Q1 in a common base configuration and comprises a class "C" modified type of Colpitts common base oscillator. The emitter of the transistor Q1 is coupled to a capacitor C1 which is a microstrip element. The lower portion of the microstrip element C1 is coupled to one side of a radio frequency choke (RFC) whose other side is coupled to a return conductor 48. Choke L1 isolates the microwave signal from the dc power source. The base of transistor Q1 is coupled to discrete capacitor C2, a resistor R1 and a resistor R2. The other sides of both capacitor C2 and resistor R1 are coupled to return conductor 48 which is coupled to terminal 44. The other side of resistor R2 is coupled to the positive voltage at terminal 42 via a conductor 50. The collector of Q1 is coupled to a capacitor C2 made of microstrip. All microstrip elements are disposed on a Teflon fiberglass substrate 52. In operation, the capacitor C1 connected to the emitter of Q1 and the transistor parasitic capacitances provide feedback to sustain oscillations at the desired frequency which in the embodiment is 915 MHz. Microstrip elements forming capacitors C2 and C3 and inductors L2 and L3 present the collector output circuit of transistor Q1 with the proper load impedance at plane D–D′ in order that the power source may operate efficiently and at the required output level. The feedback circuit comprising C1 and the transistor parasitic capacitances and the output impedance circuit comprising C2, L2, C3 and L3 are not independent and this makes optimum performance somewhat empirical. A typical performance of this microwave oscillator operating into a 50 ohm load is 3 watts cw at approximately 915 MHz with a Vcc (the voltage across terminals 42 and 44) of 20 volts dc and 7.5 watts cw at approximately 915 MHz with a Vcc of 26 volts dc. The efficiency of conversion from dc to 915 MHz in both examples is near 50%.

The output of the microwave oscillator 46 is applied to a solid state microwave power amplifier 60 for increasing the power level of the microwave signal. The amplifier 60 includes a power transistor Q2 in a common base configuration with the collector circuit of the transistor amplifier forming the output of the microwave power source. The input to the class "C" power amplifier at the plane C–C′ has been adjusted to be 50 ohms by transforming the running input impedance of Q2 by using microstrip reactive components. This allows all of the output of the microwave oscillator to be used to drive the amplifier 60. The transforming elements include microstrip capacitive elements C4 and C5 and inductive element L4. A dc blocking capacitor C6 is coupled between microstrip elements L3 and L4. The emitter of transistor Q2 is coupled to microstrip capacitive element C5 and to one side of a radio frequency choke L5 whose other side is coupled to the base of transistor Q2. The collector of transistor Q2 is dc coupled to terminal 42, which provides the voltage +Vcc via inductive microstrip element L6, a radio frequency choke L10 and conductor 50, and the base of transistor Q2 is coupled to terminal 44 via the conductor 48. Conductor 48 is, in fact, the power source heat sink material.

The transistor Q2 is a specially designed high powered device and may be obtained from Power Hybrids, Inc., Torrance, Calif. under manufacturer's identification No. PHI8243. The approximate specifications of transistor Q2 are as follows:

$P_{max}$; 50 watts
$f_o$; 915 MHz
$P_{gain}$; 7dB
Vcc; 28 volts
Max. Junction temperature; 200° C
Collector Efficiency; 60%

A typical performance of this special designed amplifier operating into a matched load is 40 watts cw at approximately 915 MHz with 26 volts dc and 7.5 watts drive power supplied. Both the microwave oscillator 46 and the microwave amplifier 60 have been designed so only one dc supply voltage is required to control the power turn-on and running levels for the electrodeless lamp 20. This dc power source must be capable of 3.5 amperes dc. The microwave power source of the light source 10 is approximately 50% efficient in converting dc power to 915 MHz watts cw power. Accordingly, the heat sink 18 is provided to adequately dissipate the resulting 40 watts of heat when the lamp is in the full running condition.

According to the invention, the microstrip elements between planes A–A' and B–B' form an impedance matching device including a length *l* of transmission line which is effective to transform the input impedance of the fixture 24 after the lamp 20 is started and before the lamp is in a running condition to a level at the collector of the transistor Q2 which allows for maximum delivery of power to the lamp when the microwave power source receives reduced dc power and which maintains the amplifier collector voltage at an acceptable level during the time when a large impedance mismatch occurs between the amplifier output impedance and the fixture input impedance. More specifically, this section of impedance matching is such that when, for example, 20 volts dc is applied to the microwave power source and the lamp 20 has just been brought to a glow condition, an acceptable impedance is transformed back to the collector of the transistor Q2 at plane B–B' from the input of the fixture at section A–A'. In addition, it is designed so that at the same time a sufficient amount of power is supplied to the lamp for running. The matching circuit allows the lamp to run in a warm-up mode to a point where the lamp causes an impedance at A–A' which when transformed back to the collector at B–B' presents a near conjugate match to the effective transistor output impedance. At this point, the lamp receives the maximum power that the power source is capable of at that voltage level. Subsequent increases in voltage applied to the power source cause increased microwave power delivered to the lamp. Lamp impedance is a function of applied power. However, the lamp is relatively stable and in the arc mode by this time and the impedance changes resulting from the changing power level in this mode are not nearly as large as those which must be contended with during the initial stages of the glow to arc transition period.

The amount of power available for running a lamp just after start-up (high impedance) is determined by a position dependence of the microwave transistor Q2 with respect to the lamp 20. The length *l* of transmission line with 50 ohms characteristic impedance is designed to effectively move the load impedance for the solid state microwave power source to a value which is both acceptable to the source in terms of power available for running just after start-up, and, at the same time, to a value which does not impose excessive standing waves on the source. In the exemplary embodiment, the length *l* was found to be about 0.13λ or 2.7 cm at 915 MHz on the Teflon-fiberglass microstrip board.

Figure 3:
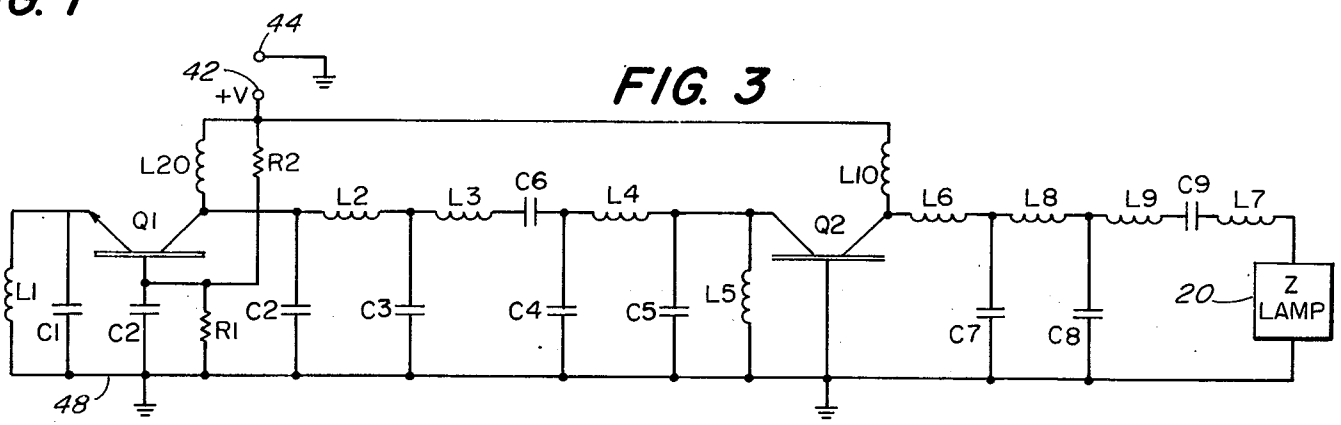
FIG. 3 is a lumped element equivalent of the microwave power source shown pictorially in FIG. 2.

FIG. 3 is a lumped element equivalent circuit of the pictorial representation shown in FIG. 2. As may be seen, all of the impedance matching reactive components, i.e., inductors and capacitors, have been formed using microstrip line elements. In the case of capacitors, these are open circuited lengths of line with a characteristic impedance $Z_o$ determined by the conductor width to height ratio, such as is described in more detail in *Microwave Engineer's Handbook*, ARTECH, Vol. 1, 1971 and capacitive reactance $X_c$ determined by the following relation:

$$X_c = Z_o \operatorname{Cot} \beta l$$

where $\beta = 2\pi/\lambda_g$
$\lambda_g$ = guide wavelength
$l$ = length

The inductors are formed using relatively narrow lengths of transmission line and have reactive effect which is determined by the characteristic impedance of the line and their position on the Smith Chart. A radio frequency choke L20 is shown in FIG. 3 coupled between the collector of Q1 and terminal 42 and represents the inductance of the conductor 50 in FIG. 2.

The embodiment of the present invention is intended to be merely exemplary and those skilled in the art shall be able to make numerous variations and modifications of it without departing from the spirit and scope of the present invention. All such variations and modifications are intended to be within the scope of the present invention as defined by the appended claims.

We claim:

1. In a light source having a microwave power source, an electrodeless lamp with a light-transmitting envelope and a volatile fill material which emits light upon breakdown and excitation and a termination fixture having an inner conductor and an outer conductor disposed around the inner conductor, the conductors having a first end coupled to the microwave power source and a second end associated with the lamp so that the microwave power terminates at the lamp to initiate breakdown and excitation of the fill material, the fixture further having means for matching the impedance of the lamp in a running condition to the output impedance of the microwave power source, means providing a starting assist for the lamp and for reducing the output of the microwave power source at starting, an improved microwave power source comprising:

a. a dc power source capable of providing power at variable levels,
b. a solid state microwave oscillator, responsive to the output of the dc power source, for generating a microwave signal,
c. a solid state microwave power amplifier, responsive to the output of the dc power source, for increasing the power level of the microwave signal, the amplifier including a power amplifying transistor with the collector circuit of the transistor forming the output of the microwave power source, and d. impedance matching means coupled between the amplifier and the first end of the conductors of the fixture including a length of transmission line which is effective to transform the dynamic input impedance of the fixture after the lamp is started and before the lamp is in a running condition to a value at the collector of the transistor in the amplifier that is acceptable to the transistor and which allows an amount of power to be delivered to the lamp, even when the amplifier receives reduced dc power, sufficient to cause the lamp to warm-up to the running condition, the impedance matching means further maintaining the voltage at the collector of the amplifying transistor at an acceptable level during the time when a large impedance mismatch occurs between the amplifier output impedance and the input impedance of the fixture.

2. The power source according to claim 1 wherein the length of transmission line has a characteristic impedance equal to the input impedance of the fixture when the lamp is in the running condition.

3. The power source according to claim 2 wherein the length of transmission line is microstrip.

4. The power source according to claim 1 further including means for controlling the brightness of the lamp in the running condition.

5. The power source according to claim 4 wherein the means for controlling the brightness includes potentiometer means for varying the magnitude of the dc voltage bias from the dc source which is applied to the microwave power amplifier.

6. The power source according to claim 1 wherein the dc source provides the microwave oscillator and amplifier with the same level of dc voltage.

7. The power source according to claim 1 further including means for matching the collector load impedance of the transistor in the oscillator to the input impedance of the transistor in the microwave power amplifier.

8. The power source according to claim 7 wherein the collector load impedance matching means includes inductive elements formed of microstrip transmission line and capacitive elements formed of microstrip stubs.

9. The power source according to claim 1 further including a heat sink means for dissipating heat from the power source.

10. The power source according to claim 9 wherein the dc power source, the microwave oscillator, and the microwave power source are formed on a single integrated circuit on a substrate having a high dielectric constant to promote miniaturization.

11. The power source according to claim 10 wherein the light source is formed substantially in the form of an incandescent lamp having:

a. a neck portion including:
   1. a screw base adapted to receive ac power and the dc power source being an ac to dc converter,
   2. a section adjacent the screw base housing at least a portion of the power source, and
   3. a heat sink adjacent the power source housing section for dissipating heat from the power source, and b. an envelope section including:
   1. the outer conductor being adjacent to the heat sink and formed in a dome shape and being made of a light-transmitting material and a mesh made of a conductive material, and
   2. the inner conductor and the electrodeless lamp being disposed within the dome shaped outer conductor.

12. In a light source having a microwave power source, an electrodeless lamp with a light-transmitting envelope and a volatile fill material which emits light upon breakdown and excitation and a termination fixture having an inner conductor and an outer conductor disposed around the inner conductor, the conductors having a first end coupled to the source and a second end associated with the lamp so that the microwave power terminates at the lamp to initiate breakdown and excitation of the fill material, the fixture further having means for matching the impedance of the lamp in a running condition to the output impedance of the source, means providing a starting assist for the lamp and for reducing the output of the microwave power source at starting, an improved microwave power source comprising a. a dc power source capable of providing power at variable levels, b. a solid state microwave oscillator, responsive to the output of the dc power source, for generating a microwave signal, the oscillator including a transistor in a common base configuration, c. a solid state microwave power amplifier, responsive to the output of the dc power source, for increasing the power level of the microwave signal, the amplifier including a power amplifying transistor in a common base configuration with the collector circuit of the transistor forming the output of the microwave power source, d. impedance matcing means coupled between the amplifier and the first end of the conductors of the fixture including a length of transmission line which is effective to transform the dynamic input impedance of the fixture after the lamp is started and before the lamp is in a running condition to a value at the collector of the transistor in the amplifier that is acceptable to the transistor and which allows an amount of power to be delivered to the lamp, when the amplifier receives reduced dc power, sufficient to cause the lamp to warm-up to the running condition, the impedance matching means further maintaining the voltage at the collector of the amplifying transistor at an acceptable level during the time when a large impedance mismatch occurs between the amplifier output impedance and the imput impedance of the fixture, and e. the dc power source and the microwave oscillator and power amplifier being formed on a single integrated circuit on a substrate having a high dielectric constant to promote miniaturization.

13. The power source according to claim 12 wherein the light source is formed substantially in the form of an incandescent lamp having:

a. a neck portion including:
   1. a screw base adapted to receive ac power and the dc power source being an ac to dc converter,
   2. a section adjacent the screw base housing at least a portion of the power source, and
   3. a heat sink adjacent the power source housing section for dissipating heat from the power source, and b. an envelope section including:
   1. the outer conductor being adjacent to the heat sink and formed in a dome shape and being made of a light-transmitting material and a mesh made of a conductive material, and
   2. the inner conductor and the electrodeless lamp being disposed within the dome shaped outer conductor.

* * * * *